US006747683B2

(12) United States Patent
Nakajima et al.

(10) Patent No.: US 6,747,683 B2
(45) Date of Patent: Jun. 8, 2004

(54) THERMAL HEAD CONTROL METHOD AND CONTROL APPARATUS

(75) Inventors: Satoshi Nakajima, Horigane-mura (JP); Naohiko Koakutsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 100 days.

(21) Appl. No.: 10/170,886

(22) Filed: Jun. 13, 2002

(65) Prior Publication Data

US 2002/0191067 A1 Dec. 19, 2002

Related U.S. Application Data

(60) Provisional application No. 60/364,220, filed on Mar. 13, 2002, and provisional application No. 60/365,652, filed on Mar. 18, 2002.

(30) Foreign Application Priority Data

Jun. 14, 2001 (JP) ..... 2001-180233

(51) Int. Cl.[7] ..... B41J 2/355; B41J 2/36

(52) U.S. Cl. ..... 347/211; 347/195

(58) Field of Search ..... 347/188, 195, 347/211; 400/120.09, 120.15

(56) References Cited

U.S. PATENT DOCUMENTS 4,789,872 A * 12/1988 Hosoi
5,376,952 A 12/1994 Kokubo et al.
5,625,394 A 4/1997 Fukuda et al.
6,342,911 B1 1/2002 Moriya
6,476,839 B1 * 11/2002 Nakajima et al. ..... 374/195

FOREIGN PATENT DOCUMENTS

| | | |
|---|---|---|
| EP | 1 070 593 | 1/2001 |
| JP | 59-190867 | 10/1984 |
| JP | 10-93792 | 4/1998 |
| JP | 2836584 | 10/1998 |
| JP | 2000-168116 | 6/2000 |
| JP | 2000-280511 | 10/2000 |
| JP | 2001-80099 | 3/2001 |
| JP | 2001-88340 | 4/2001 |

* cited by examiner

*Primary Examiner*—Huan Tran
(74) *Attorney, Agent, or Firm*—Rosalio Haro

(57) ABSTRACT

A control method and apparatus for a thermal head capable of printing two colors applies thermal history control using a simple circuit configuration. The thermal head control apparatus has a print data processing unit 40 and a drive control circuit 50. The print data processing unit 40 has a first command processing function for converting first color data to a first and second stage energizing commands, a second command processing function for converting second color data to a second stage energizing command, a first line buffer 43 for storing first stage energizing commands, and a second line buffer 44 for recording second stage energizing commands. The print data processing unit 40 selectively outputs energizing commands from the first line buffer 43 and energizing commands from the second line buffer 44. The drive control circuit 50 has a print buffer 52 and history buffer 53, and energizes the heating elements of the thermal head 10 based on energizing commands determined by a comparison of content stored to the print buffer 52 and history buffer 53.

15 Claims, 9 Drawing Sheets

THERMAL HEAD CONTROL METHOD AND CONTROL APPARATUS

CONTINUING APPLICATION DATA

This application claims the benefit of U.S. Provisional Application Nos. 60/364,220, filed Mar. 13, 2002 and 60/365,652, filed Mar. 18, 2002.

BACKGROUND OF THE INVENTION

1. Field of the Invention

The present invention relates to technology for controlling the heat value of heating elements in a thermal head.

2. Description of the Related Art

Generally speaking a thermal head produces heat by independently passing a specified current to each heating element in order to form a dot pattern on thermal paper. The amount of heat is controlled by regulating the energizing time, or more specifically the energizing pulse width.

The thermal head also has a heat storage characteristic such that heat accumulates as the current supplied to a same heating element is maintained. This brings about the use of a characteristic called energizing history, which is a determination of the heat stored in thermal head based on the amount of energizing time, i.e. current, previously supplied to the thermal head. Thermal history control is therefore applied to keep the heat output from the heating element constant by shortening the energizing pulse width according to its energizing history.

This thermal history control functions by transferring one line of print data for each heating element row to a print buffer for temporary storage and to a history buffer for storage as history data. A logic operation is then performed on the print buffer data and history buffer data in order to determine the energizing pulse width for the next print data for each heating element; a short pulse width is sent to the thermal head for application to heating elements that operated (i.e. were energized for printing) immediately before, and a normal pulse width is sent to the thermal head for application to heating elements that did not print (i.e. were not energized) immediately before.

Thermal paper has a paper base with a heat-sensitive coating that produces color when a certain amount of heat is applied. Two-color thermal paper that produces different colors according to the difference in the applied heat is also known.

When this two-color thermal paper is used with the above-described thermal head, it is desirable to be able to selectively use a two-color mode for printing two colors (such as black and red) and a monochrome mode for printing only one color (such as black).

To achieve this, it is necessary to selectively generate both long energizing pulse widths for high heat output and short energizing pulse widths for low heat output when using the two-color mode.

The problem with this is that the circuit for controlling the energizing of the thermal head's heating elements becomes complex when using two-color thermal paper.

A further problem with two-color printing is that the low-heat output color appears like a ghost around the edges of the high-heat output color.

OBJECTS OF THE INVENTION

Therefore, it is an object of the present invention to overcome the aforementioned problems.

It is a further object of the present invention to provide a two-color printing control circuit/method that eliminates, or significantly reduces, ghost effect of the low-heat output color around the high-heat output color.

SUMMARY OF THE INVENTION

The present invention is directed to solving these technical problems and an object of the invention is to provide a control apparatus and a control method for a thermal head capable of printing two colors and applying thermal history control while featuring a simple circuit configuration.

One aspect of the present invention assumes that the above described problems are at least partly caused by insufficient time for distributing heat evenly across the heating elements and on to the thermal paper.

To achieve these objects, a thermal head control method for controlling different heat output levels by changing amount of energizing applied to heating elements of the thermal head, comprising the steps of: (a) energizing heating elements in a first energizing stage and in a second energizing stage to produce a first color at a first heat output level, and (b) providing a pause of a predetermined duration between the first energizing stage and the second energizing stage.

When printing with the color produced by the first heat output level to the same dot on the thermal paper, the present invention separately applies the first and second energizing stages to assure the heat output required to produce the color emitted at the first heat level, which actually prints the same dot twice. A sharp, clear first color print image can thus be achieved.

Further preferably, the pause of the predetermined time period is of sufficient time for the second energizing stage to distribute the first heat output level substantially throughout the entire surface of the heating elements.

Thus the temperature of the heating elements distributed to thermal paper and becomes substantially even on it. A sharp, clear print image can be achieved.

Yet further preferably, the first energizing stage is greater than the second energizing stage.

By thus setting the first stage heat level higher than the second stage heat level, the same dot on the thermal paper is first printed using a dark color and is printed a second time using a lighter color, thereby assuring a well-defined print image. It is also possible to rapidly heat the thermal head heating elements when printing to thermal paper using the first heat output level.

The invention also provides a thermal head control method for energizing heating elements only in the second energizing stage to produce a second color at a second heat output level.

When printing with the color produced by the second heat output level, the present invention can thus sufficiently cool the heating elements of the thermal head by energizing the thermal head only in the second stage and not in the first stage. It is therefore not necessary to consider thermal history.

Further preferably, the energizing level in the second energizing stage is sufficient to produce a second color at a second heat output level.

In the second stage, the heat output is required to produce the color emitted at the second heat level. A sharp, clear second color print image can thus be achieved.

To further achieve the above objects, the present invention also provides a thermal head control apparatus according to the present invention for controlling heat output from heating elements of the thermal head by changing the energizing of each heating element in the thermal head, which has an array of multiple independently drivable heating elements. The thermal head control apparatus has a print data processing unit for processing a print data group that is information relating to producing color at a specific heating element according to different heat output levels, and a drive control circuit. The print data group contains both or either first color data based on a first heat output level and second color data based on a second heat output level that is lower than the first heat output level. The print data processing unit has a first command processing function for converting first color data to a first stage energizing command and a second stage energizing command, a second command processing function for converting second color data to a second stage energizing command, a first memory area for storing the first stage energizing command, and a second memory area for recording the second stage energizing command, and selectively outputs energizing commands from the first memory area and energizing commands from the second memory area. The drive control circuit has a first command storage area for storing energizing commands contained in the first memory area or second memory area, and a second command storage area for storing energizing commands contained in the first command storage area, and energizes a specific heating element by means of a energizing command based on a comparison of content stored to the first command storage area and the second command storage area.

The invention thus comprised sets aside first and second memory areas in the print data processing unit, and applies the result of an operation on the first color data and second color data to the drive control circuit. The output temperature of the thermal head heating elements can therefore be held constant with consideration for thermal history even when the drive control circuit is a circuit enabling thermal history control for monochrome printing, and the heat output required to produce the first color and the heat output required to produce the second color can be separately controlled and achieved in the individual heating elements of the thermal head.

It is therefore possible to provide a control apparatus featuring a simple circuit configuration and applying thermal history control for a thermal head capable of printing two colors.

Preferably, the first command processing function of the print data processing unit extracts first color data from the print data group to a first working area and stores it to the first memory area, and the second command processing function extracts second color data from the print data group to a second working area and stores the result of a logic operation on the first working area and second working area to the second memory area.

First stage information can therefore be recorded in a first memory area for first color output data, and second stage information can be stored in a second memory area for first and second color output data. As a result, information relating to the heat output required to produce the first color can therefore be applied to the drive control circuit in first and second stages, and information relating to the heat output required to produce the second color can be applied to the drive control circuit as second stage data.

Further preferably, the print data processing unit converts first stage energizing commands and second stage energizing commands to multiple energizing commands stored to the memory areas based on print data and the history of energizing the heating elements.

Thus comprised, heat output for producing the first color can be controlled using a first stage energizing command and a second stage energizing command, and heat output for producing the second color can be controlled using the second stage energizing command.

It is yet further effective for the multiple first and second stage energizing commands to be energizing pulses, and determine energizing pulse width according to the heat output required to produce the first color.

Thus comprised the heat output required to produce the first color can be controlled using the energizing pulse width determined by a plurality of first and second stage energizing commands.

It is also effective to determine the energizing pulse width of the multiple second stage energizing commands according to the heat output required to produce the second color.

Thus comprised the heat output required to produce the second color can be controlled using the energizing pulse width determined by a plurality of second stage energizing commands.

Yet further preferably, the initial first stage energizing command is determined according to the relationship between heat output due to multiple second stage energizing commands and the cooling temperature of the thermal head heating element.

Thus comprised the energizing pulse width of the initial first stage energizing command can be appropriately changed, and the pause of the predetermined time period, so that the temperature generated in the first stage and second stage is flat for a particular heating element of the thermal head. A sharp, clear first color print image can thus be achieved.

Yet further preferably the initial second stage energizing command is determined according to the relationship between heat output due to multiple first stage energizing commands and the cooling temperature of the thermal head heating element.

Thus comprised the energizing pulse width set by the initial second stage energizing command can also be appropriately changed so that the temperature generated in the second stage is flat for a particular heating element of the thermal head. A sharp, clear second color print image can thus be achieved.

Yet further preferably, the drive control circuit runs a last first stage energizing command or last second stage energizing command directly from the command storage area based on the print data, and runs energizing commands other than the last first stage energizing command or last second stage energizing command based on a NOT-AND operation between a command storage area written according to the energizing print data and a previous-print-data command storage area.

Thus comprised, it is also possible to selectively energize the heating elements of the thermal head in order to achieve the basic heat output level required to produce the first and second colors, and to achieve the heat output required to produce the first and second colors with consideration for thermal history.

Yet further preferably, the drive control circuit comprises a energizing output circuit for outputting an N-th strobe signal at a specific timing for an N-th energizing command (where N is a positive integer).

Thus comprised the multiple first and second stage energizing commands can be easily generated.

Yet further preferably, the control apparatus uses the drive control circuit for monochrome printing, and by using only the first stage energizing command prints one line using half the energizing commands used for two-color printing.

Thus comprised the invention also achieves a thermal head printer using a monochrome printing drive circuit applying thermal history control to enable sharp, clear monochrome and two-color printing.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Preferred embodiments of the present invention are described below with reference to the accompanying figures.

Figure 1:
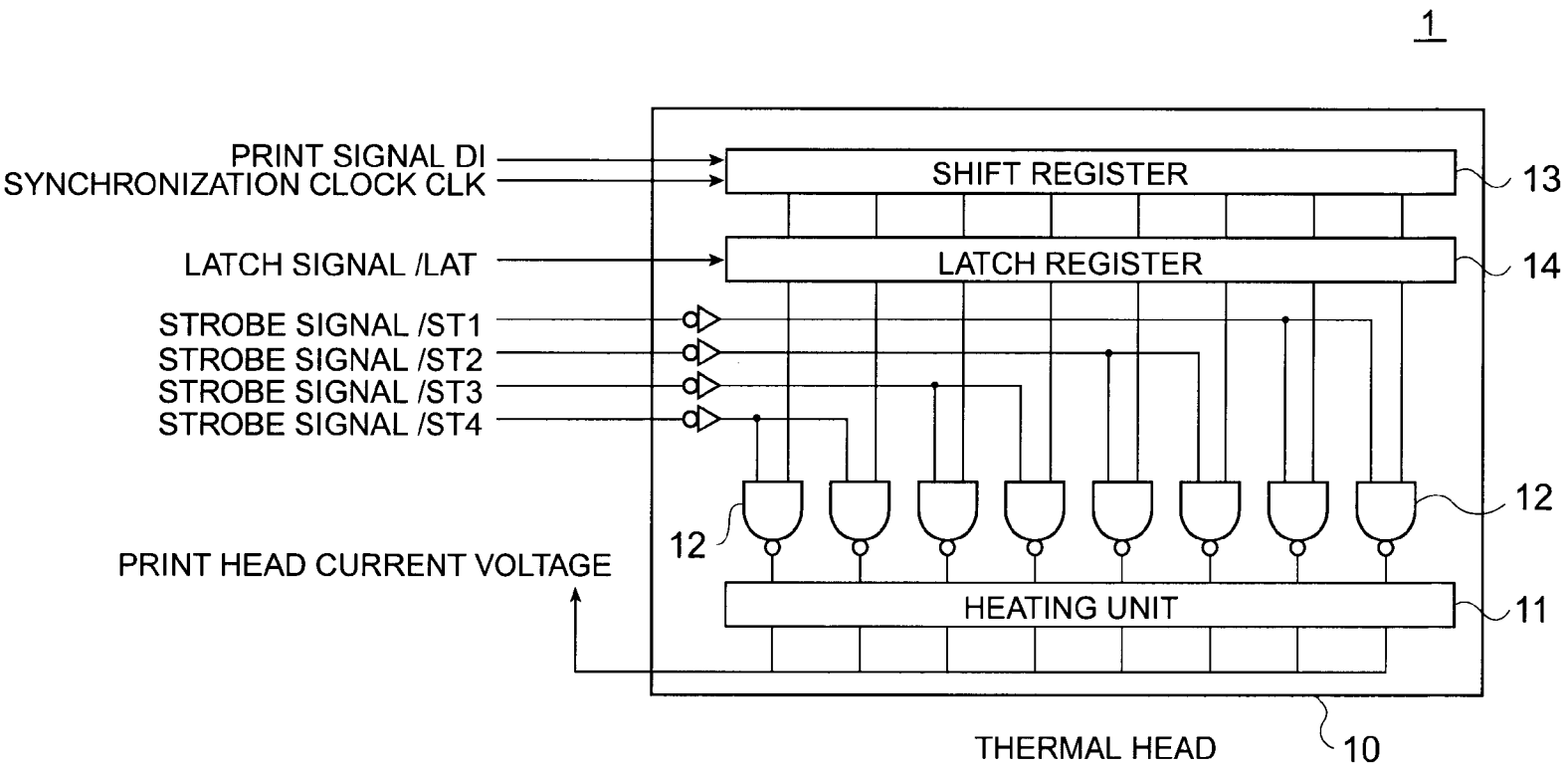
FIG. 1 is a block diagram showing the basic configuration of a thermal head according to this embodiment of the invention.
Figure 2:
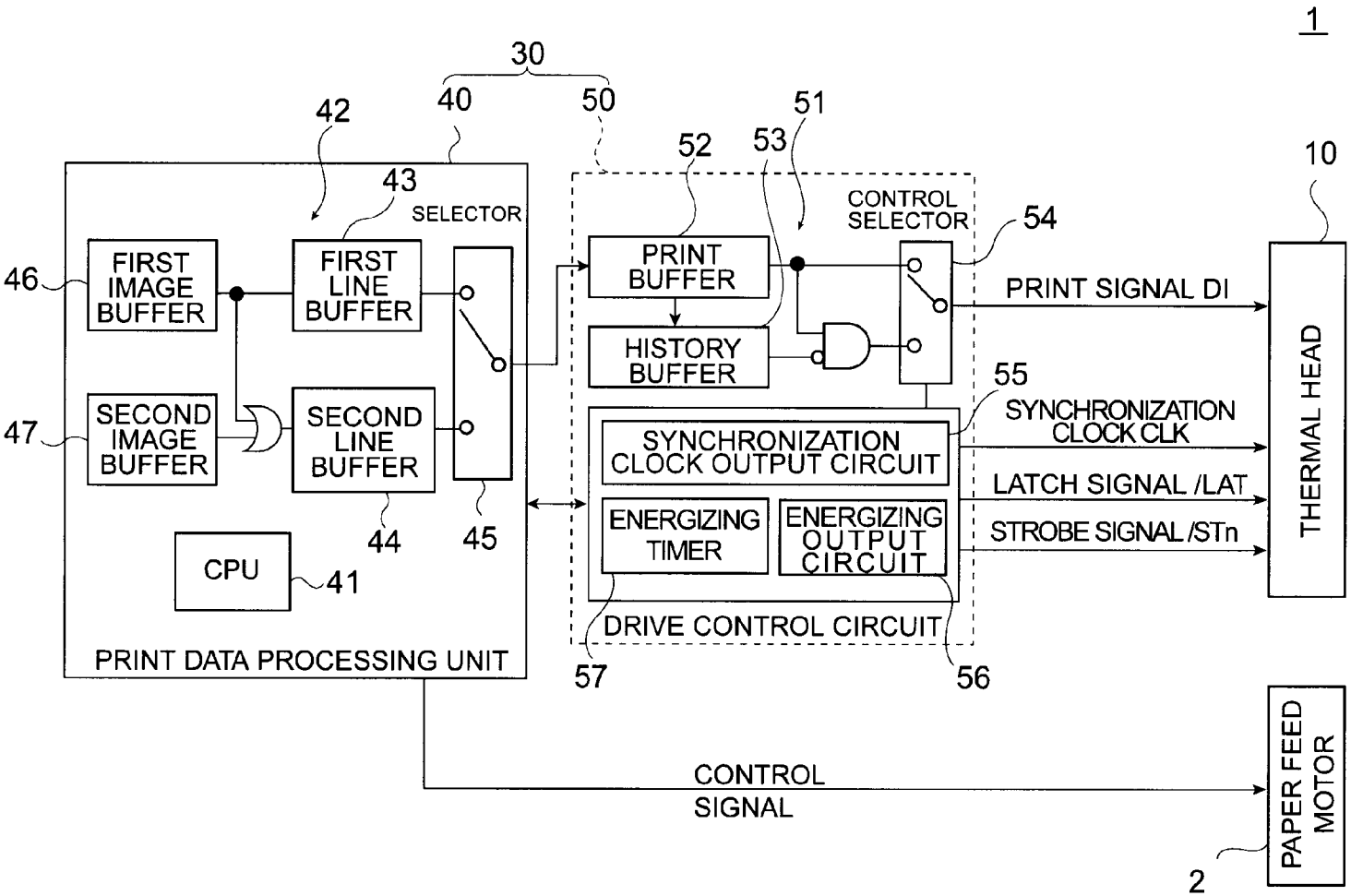
FIG. 2 is a block diagram showing the basic configuration of a control apparatus for the same thermal head.
Figure 3:
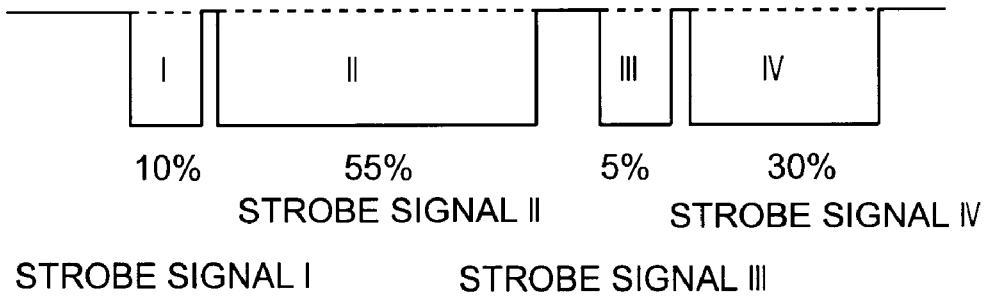
FIG. 3 shows the strobe signal ratio in the thermal head control apparatus.

FIG. 1 is a block diagram showing the basic configuration of a thermal head according to this embodiment of the invention. FIG. 2 is a block diagram showing the basic configuration of a control apparatus for the same thermal head. FIG. 3 shows the strobe signal ratio in the thermal head control apparatus.

With reference to FIG. 1 and FIG. 2, a thermal printer 1 according to this embodiment has a thermal head 10 and a thermal head control apparatus 30.

History control in this embodiment is a "first generation history" control method, that is, a method whereby the history data for a currently driven dot is based on the presence of immediately preceding print data.

The thermal head 10 has a heating unit 11 with a plurality of independently drivable heating elements arranged in line. This heating unit 11 forms a desired dot pattern on thermal paper in conjunction with transportation of the thermal paper by a paper feed roller (not shown in the figure) driven by a paper feed motor 2.

Two types of thermal paper can be used with this thermal printer 1, that is, monochrome thermal paper that produces only one color in response to applied thermal, and two-color thermal paper that produces different colors determined by how much heat is applied.

There are also two types of two-color thermal paper: additive paper that produces black when the applied heat level is high and produces red, blue, or another color when a low heat level is applied, and subtractive paper that produces red, blue, or another color when a high heat level is applied and produces black when a low heat level is applied.

The present invention can use either additive color or subtractive color type thermal paper, and is described below using a red additive color type two-color thermal paper that produces a first color (black in this embodiment) when a high heat level is applied and produces a second color (red in this embodiment) when a low heat level is applied. A drive circuit 12 is electrically connected to each heating element of heating unit 11. Each heating element produces an amount of heat that dependent on the energizing of the corresponding drive circuit 12 to produce either the first color or second color for each dot formed on the thermal paper.

It should be noted that the thermal head 10 has a shift register 13 and latch register 14, and these will be further described in detail below.

The thermal head control apparatus 30 has a print data processing unit 40 and a drive control circuit 50 electrically connected thereto.

The print data processing unit 40 has a CPU 41, ROM (not shown in the figure) for storing a signal processing program, for example, a first line buffer 43, a second line buffer 44, RAM 42 in which specific areas are reserved as a first image buffer 46 and second image buffer 47, and a selector 45. All or part of RAM 42 can alternatively be integrated in CPU 41.

The signal processing program includes a first signal processing function and a second signal processing function for generating first and second color print signals from user-specified print data containing a mixture of first color print data H and second color print data L.

The first signal processing function extracts and stores only first color print data H from the print data stream to the first image buffer 46.

The second signal processing function extracts and stores only second color print data L from the print data stream to the second image buffer 47.

The first line buffer 43 is a memory area for recording one line of print data from the first color image buffer 46 containing plural lines of print data. The second line buffer 44 is a memory area recording the logical sum of the first 46 and second 47 image buffers as the print data for one line.

The content of first image buffer 46 is transferred one line at a time to the first line buffer 43, and the logical sum (OR) of the first image buffer 46 and second image buffer 47 is transferred one line at a time to the second line buffer 44, preferably by running a program stored in ROM. The following operations are also performed by running a program stored in ROM.

The selector 45 alternatively connects first and second line buffers 43 and 44 to the drive control circuit 50 in order to selectively send content from first and second line buffers 43 and 44 sent to the drive control circuit 50.

The drive control circuit 50 includes a print signal transmission circuit 51, control selector 54, synchronization clock output circuit 55, energizing output circuit 56, and energizing timer 57.

The print signal transmission circuit 51, which sends the content of first and second line buffers 43 and 44 selectively rewritten according to thermal history to the thermal head 10, has a print buffer 52 and history buffer 53, and is connected to selector 45.

The print signal transmission circuit 51 saves the content of either first line buffer 43 or second line buffer 44 to print buffer 52, and saves the content of the print buffer 52 to the history buffer 53.

The print buffer 52 is connected to one terminal of the control selector 54, and is connected through the NOT and AND operations of the history buffer 53 to the other terminal of control selector 54.

The control selector 54 is thus connected to the shift register 13 of thermal head 10 so that it can write to the shift register 13 either the content of print buffer 52 or the result of logic operations on print buffer 52 and history buffer 53, that is, the results determined by the thermal history.

The synchronization clock output circuit 55 outputs the synchronization signal for writing the print data to the shift register 13. The print buffer or the result of the operation applied to the print buffer and the history buffer is written to the shift register based on the synchronization signal as print data indicating the on/off states of the heating unit.

The energizing output circuit 56 generates latch signals and strobe signals synchronized to the timing indicated by energizing timer 57. The latch signal is connected to the latch register 14 of thermal head 10 (see FIG. 1), and is connected to the drive circuit 12 of each heating element in thermal head 10 through a NOT operation with the strobe signal and a NAND operation with the latch register 14.

The latch register 14 records the content of the shift register 13 based on the latch signal. The print signals recorded to the latch register 14 thus determine the on/off state of the heating unit based on whether the print signal is a 1 (print) or a 0 (do not print).

Based on a energizing pulse width time table stored in RAM 42 of print data processing unit 40, the strobe signals are generated as first stage strobe signals I and II with a specific pulse width or second stage strobe signals III and IV generated a pause delay after strobe signals I and II. The pause delay is of a predetermined time period.

Figure 8:
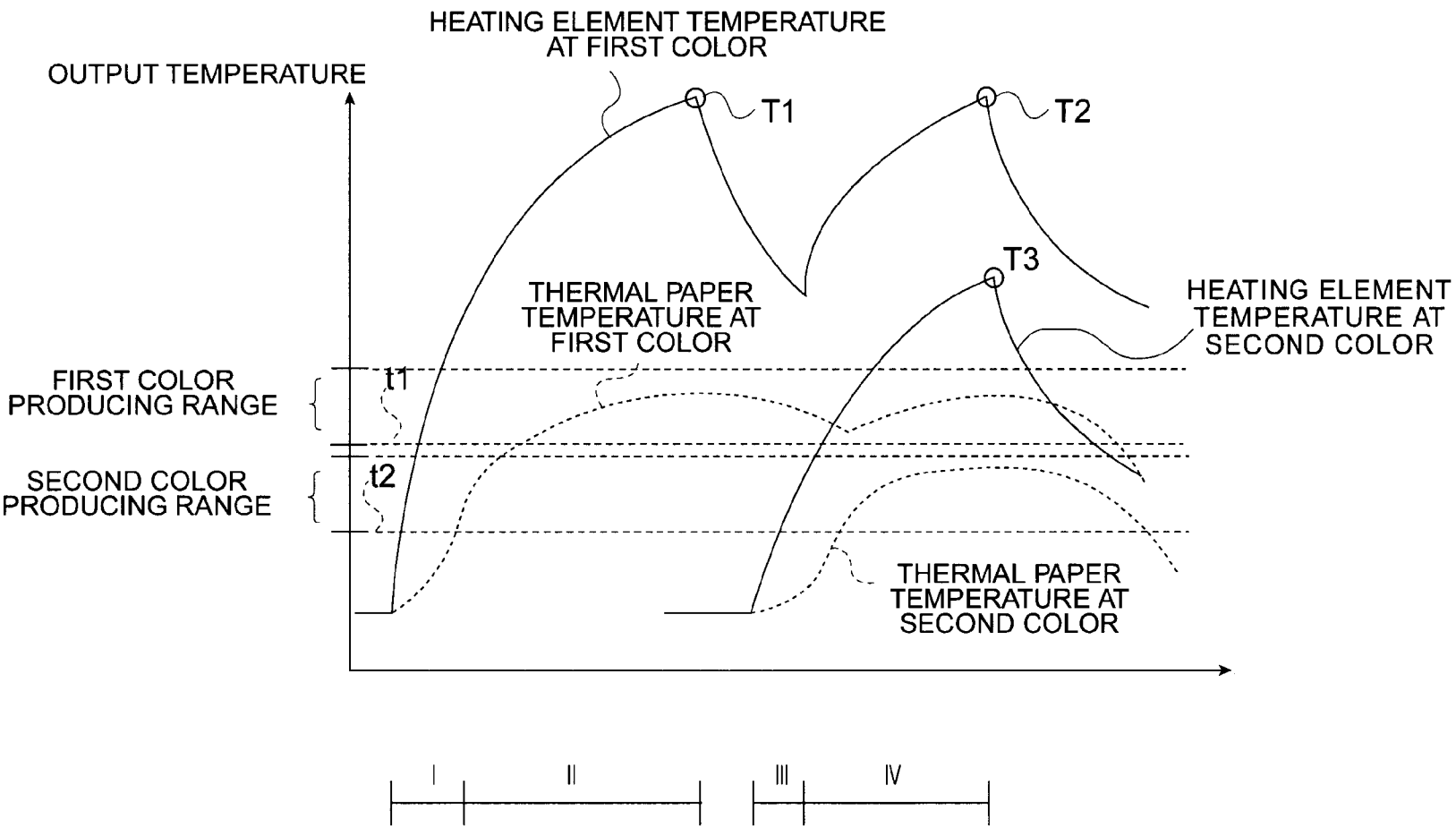
FIG. 8 shows the temperature distribution for heating elements in the thermal head.

It should be noted that as shown in FIG. 3 and FIG. 8 the ratio between the sum of first stage strobe signals I and II and the sum of second stage strobe signals III and IV is preferably (I+II)·(II+III) due to the relationship between the temperatures t1 and t2 required to produce the first and second colors and the need to apply a high heat level in the first stage in order to quickly heat the heating elements of the thermal head 10.

Furthermore, the ratio of strobe signal I to strobe signal II is preferably I·II considering the need to adjust heat output with consideration for the thermal history when front heating elements in the thermal head 10 are driven.

This embodiment, however, does not adjust strobe signal III with consideration for thermal history. While described in further detail below, this is basically because there is a time lag between strobe signal II and strobe signal III when printing the first color and it is not necessary to use strobe signal III if adjustment is made with strobe signal IV, and it is not necessary to consider thermal history because strobe signals I and II are not used when printing the second color.

The strobe signal ratio I:II:III:IV in the present embodiment is therefore 0.1:0.55:0.05:0.3.

Figure 4:
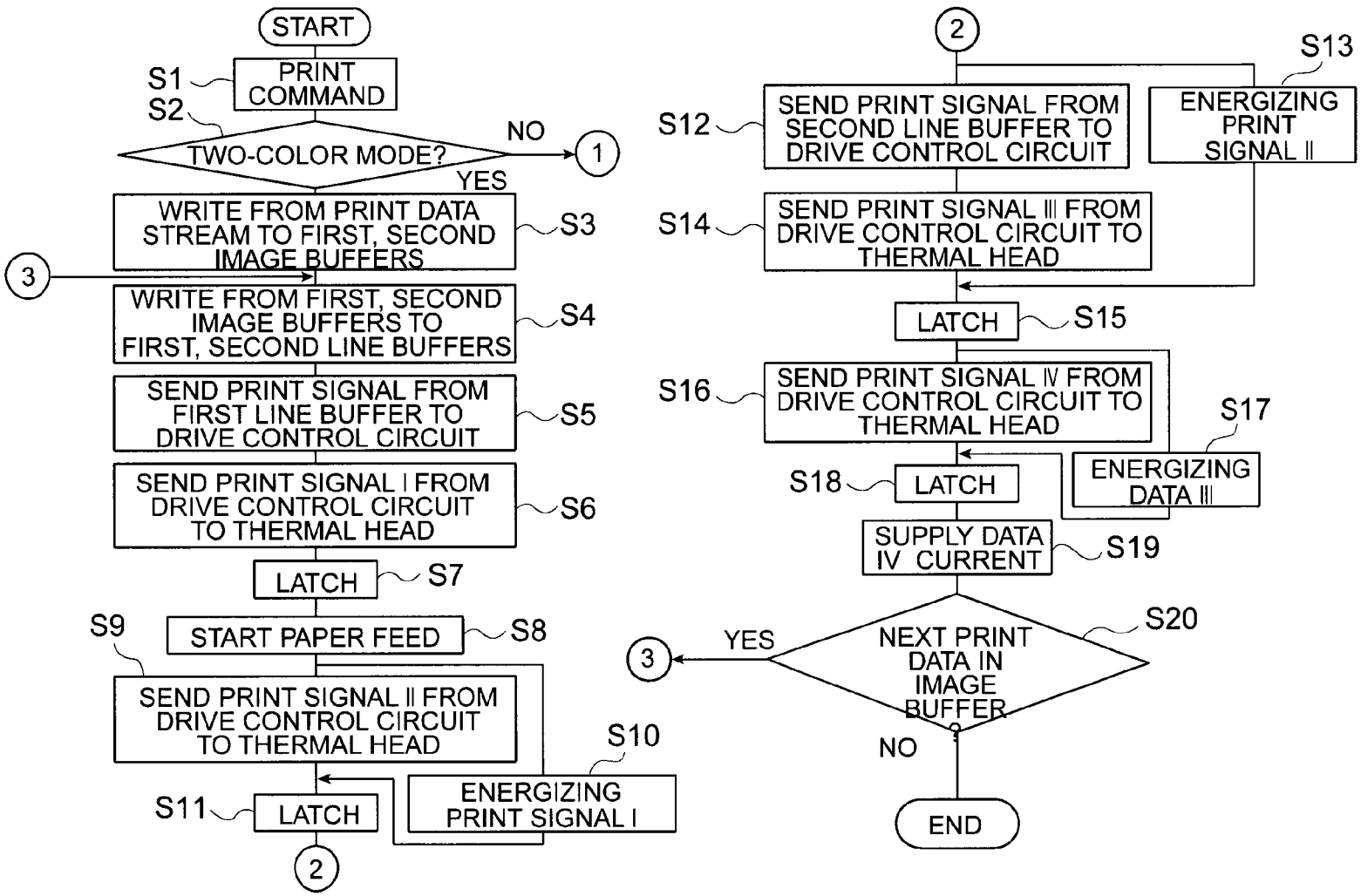
FIG. 4 and FIG. 5 are flow charts showing the process run by the control apparatus of the present embodiment.
Figure 5:
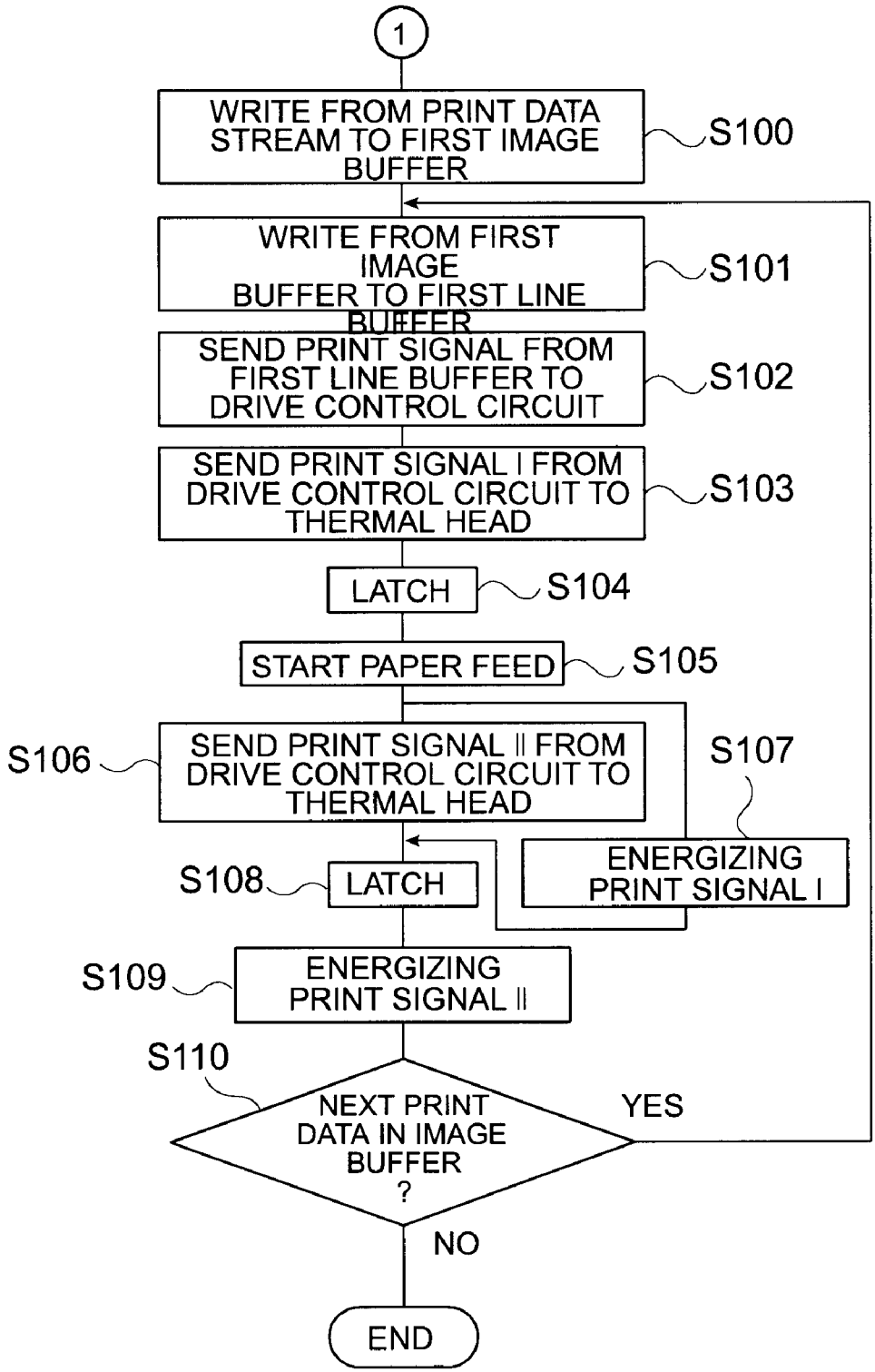
Figure 6:
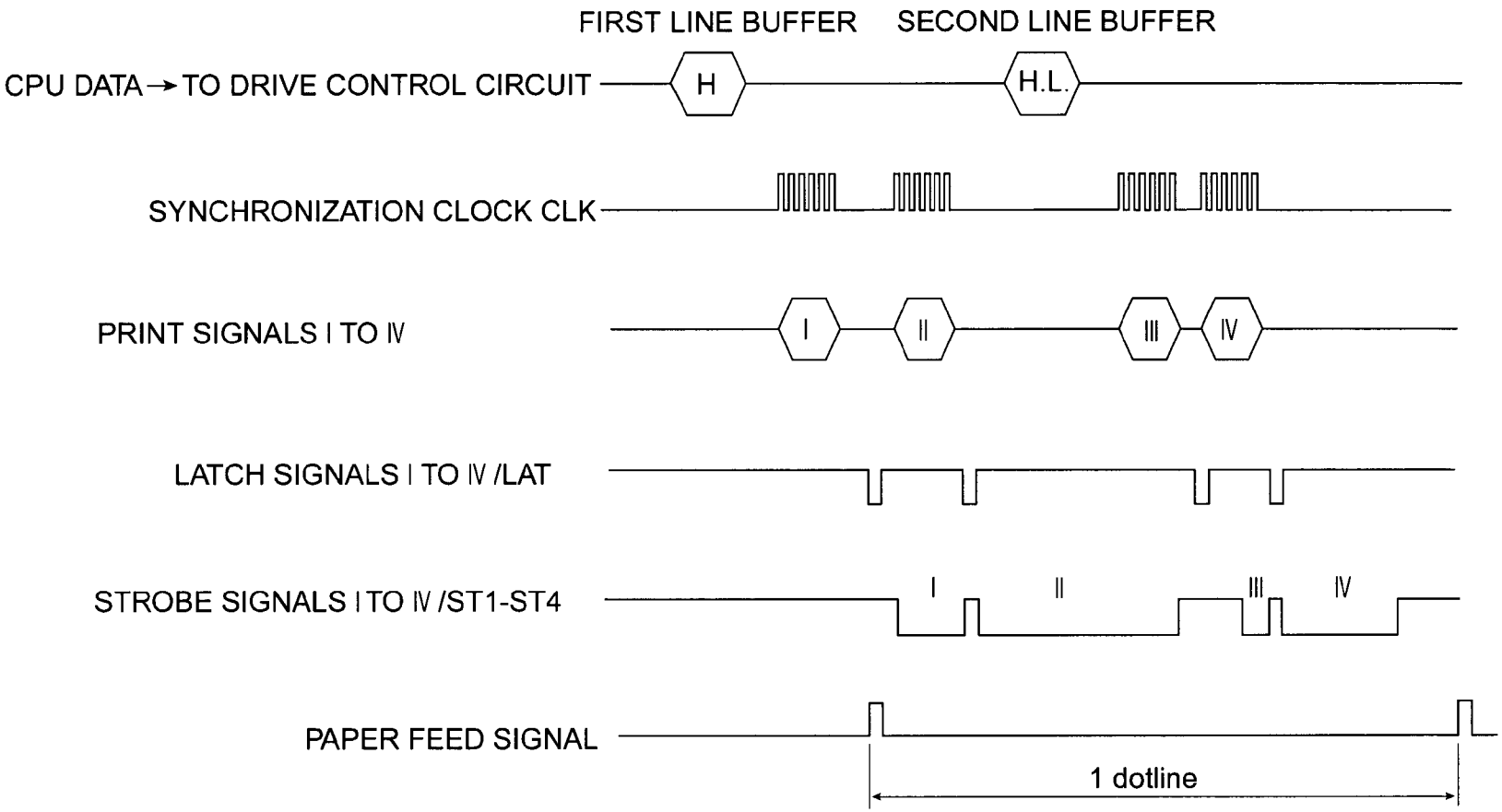
FIG. 6 is a timing chart showing the timing of this control apparatus.
Figure 7:
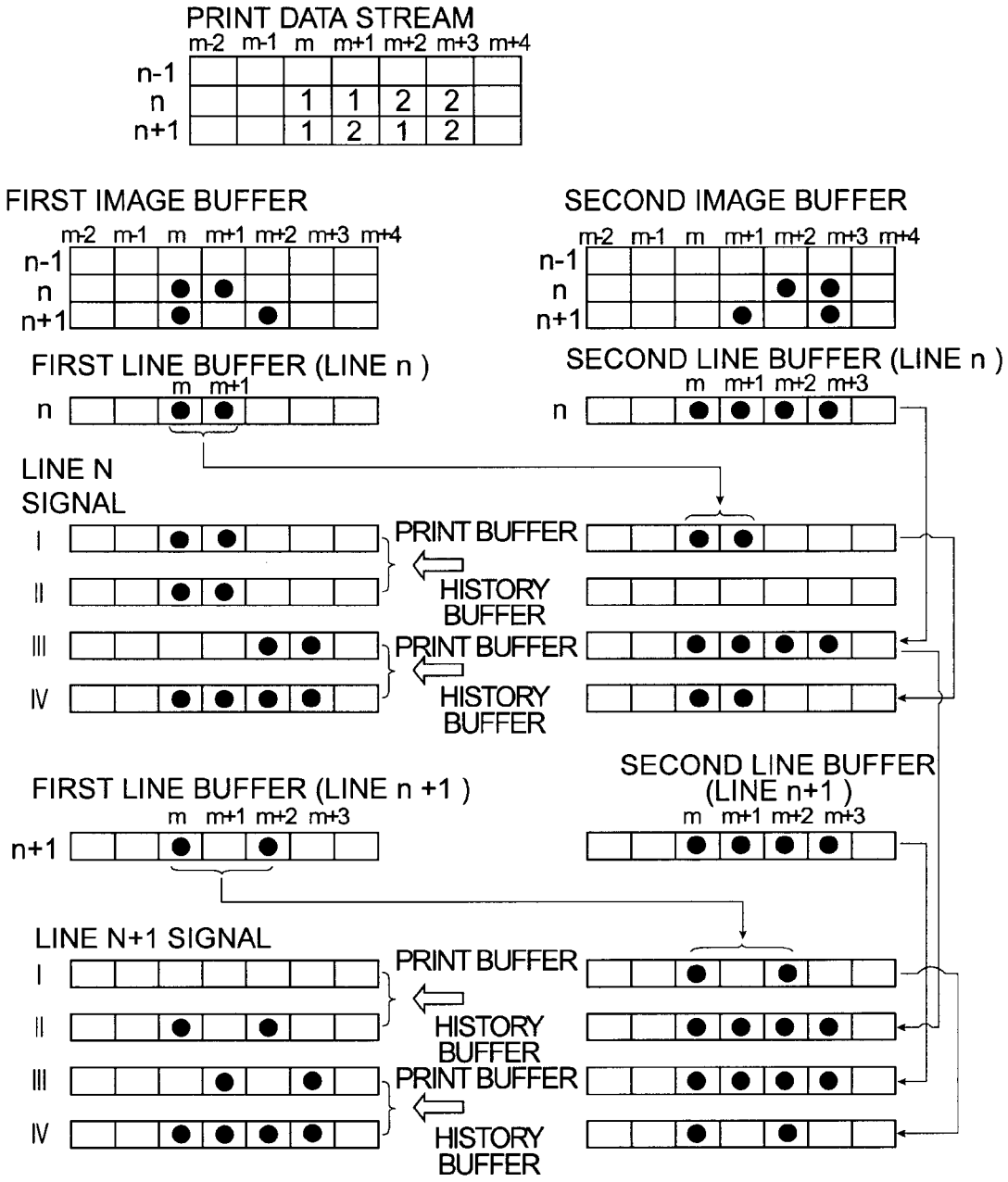
FIG. 7 shows the data configuration in this control apparatus.
Figure 9:
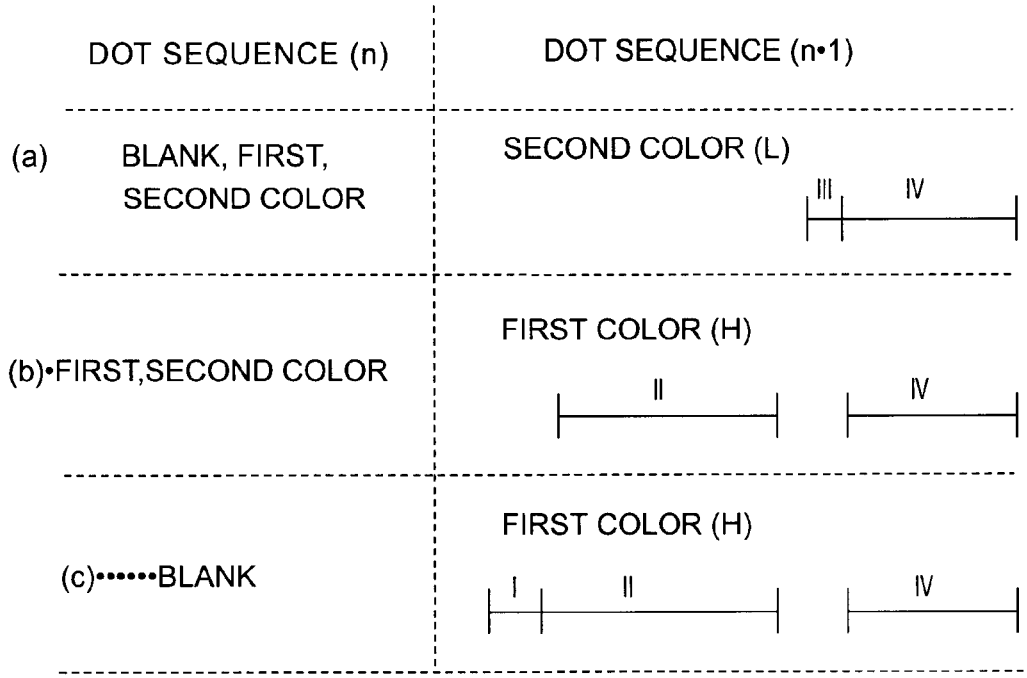
FIG. 9 shows the strobe signal configuration based on heat in this control apparatus.

FIG. 4 and FIG. 5 are flow charts showing the process run by the control apparatus of the present embodiment, and FIG. 6 is a timing chart showing the timing of this control apparatus. FIG. 7 shows the data configuration in this control apparatus, FIG. 9 shows the strobe signal configuration based on heat in this control apparatus, and FIG. 8 shows the temperature distribution for heating elements in the thermal head.

The control process run by the control apparatus of this embodiment of the invention is described next below with reference to these flow charts and timing charts.

Referring to FIG. 4, when the print data processing unit 40 of thermal head control apparatus 30 receives a print command in step S1, step S2 determines if the print mode is set to the "two-color mode" or "monochrome" mode. The print mode could be set with DIP switches, for example.

If the two-color mode is set, control steps to step S3. If the monochrome mode is set, control branches to step S100 (FIG. 5).

In step S3 the CPU 41 extracts and temporarily stores the first color print data H from the print data stream to the first image buffer 46, and extracts and temporarily stores the second color print data L from the print data stream to the second image buffer 47. FIG. 7 shows an example in which lines n and n+1 of the print data stream in the paper feed direction are printed using a heating unit 11 having a line of dots (m−2) to (m+4) and printing H, H, L, L dots from dot m in line n and H, L, H, L dots in line n+1. Dots processed as print dots in the first and second image buffers are indicated with a black dot in FIG. 7. The following description assumes printing as indicated in FIG. 7.

In step S4 the CPU 41 sends line n data for printing the content of first image buffer 46 to the first line buffer 43, and sends the result of the logical sum operation on line n data in first and second image buffers 46, 47 to the second line buffer 44.

After connecting first line buffer 43 to drive control circuit 50 by means of selector 45 in step S5, the content of first line buffer 43 is sent to the print buffer 52. Simultaneously to transferring data from first line buffer 43 to print buffer 52, data in print buffer 52 is transferred to history buffer 53 for use as the data from the previous print operation.

Then in step S6 control selector 54 is selected by a command from print data processing unit 40, and the result (dots m and m−1=1 (energizing is applied to print)) of a logic operation on print buffer 52 (first line-n data) and history buffer 53 (line n−1 data, in this case 0 (non-printing value) because nothing printed in line n−1) is sent from the first line buffer as print signal I to shift register 13 of thermal head 10. When the transfer is completed, latch signal I is sent from energizing output circuit 56 to latch register 14 of thermal head 10. This causes the print signal I in shift register 13 to move to the latch register 14.

In step S8 paper feed motor 2 is driven to start feeding the thermal paper based on a command from print data processing unit 40, and control advances to step S9 based on a control signal from paper feed motor 2.

The control selector 54 is then driven to select and pass print signal II from print buffer 52 to shift register 13 of thermal head 10 based on a command from print data processing unit 40 (step S9).

Energizing is then applied to the m and m+1 dot heating elements of thermal head 10 selected according to the print signal I content stored to the shift register 13 (step S10). After the latch signal is applied the shift register and latch register can be used independently, and energizing can be applied to the heating elements while print signal II is being transferred. The content of print signal I corresponds through the clock signal to strobe signal I, and heat determined by strobe signal I is applied to the heating elements. At step S12 second line buffer 44 and drive control circuit 50 are connected by the selector 45, and the content of second line buffer 44 is thus transferred to the print buffer 52 (see FIG. 2 and FIG. 7).

In step S11 and step S13 print signal II in the shift register 13 is transferred to the latch register 14 based on latch signal II from energizing output circuit 56, and the content (energize dots m and m+1) of print signal II is applied to the specific heating elements of the thermal head 10. Because the content of print signal II corresponds to strobe signal II, heat determined by strobe signal II is applied to the heating elements.

In step S12 second line buffer 44 and drive control circuit 50 are connected by selector 45, and the content of second line buffer 44 for line n is transferred to the print buffer 52. Synchronized to the transfer of data from second line buffer 44 to print buffer 52, data from print buffer 52 (that is, the first line buffer data) is also transferred to the history buffer 53 for use as the previous print data.

Control selector 54 then sends the result (dots m+2 and m+3 are 1) of a logic operation on print buffer 52 (second line n data from the second line buffer) and history buffer 53 (first line n data in this case) as print signal III to shift register 13 of thermal head 10 based on a command from print data processing unit 40 (step S14).

Based on latch signal III from energizing output circuit 56, print signal III is transferred from shift register 13 to latch register 14, and the content of print signal III is applied to specific heating elements of thermal head 10 in steps S15 and S17. The content of print signal III in this case (dots m+2 and m+3) corresponds through the clock signal to strobe signal III, and heat determined by strobe signal III is applied to the heating elements.

In step S16 control selector 54 is driven by a command from print data processing unit 40 to transfer print signal IV from print buffer 52 to shift register 13 of thermal head 10.

Based on latch signal IV from energizing output circuit 56 in steps S18 and S19, print signal IV in shift register 13 is transferred to latch register 14, and energizing determined by the content of print signal IV is applied to the specific heating elements of thermal head 10. In this case the content of print signal IV (dots m to m+3), that is, heat equivalent to strobe signal IV, is applied to the heating elements.

As shown in FIG. 8 and FIG. 9, when energizing equivalent to strobe signals I and II is applied to specific heating elements of the thermal head 10, the temperature applied to the thermal paper for the specific number of dots n exceeds the temperature t1 causing the thermal paper to produce the first color (first color temperature t1), and the thermal paper thus turns the first color (black in this embodiment) at those dot positions.

The first stage heat equivalent to strobe signals I and II based on the print signal is higher than the second stage heat equivalent to strobe signals III and IV, and the specific heating elements are thus raised directly to a first peak temperature T1 by the first stage heat.

After then a pause of a predetermined time period and not using strobe signal III (FIG. 9(*c*)), the same heating elements are heated to a second peak temperature T2 substantially equal to first peak temperature T1 by the second stage heat (equivalent to strobe signal IV).

The specific heating elements of the thermal head 10 thus actually print twice to the same dot of the thermal paper while decreasing the residual heat from first stage heating. Accordingly, this provides a time period sufficient to distribute the heat of the heating elements to the thermal paper, and the heating temperature on the thermal paper becomes substantially flat, i.e. even, at a level exceeding the first color temperature t1. Thus, an appearance of low heat output color around the edges of high heat output color is reduced; clear high heat output color print image can be achieved.

The process described above applies to a specific heating element of the thermal head 10, and the same process is applied to each heating element based on print data H, L in the print data stream in order to print one line in the paper width direction.

If the CPU 41 determines in step S20 that print data H, L remains in first and second image buffers 46, 47, it returns to step S4 and repeats steps S4 to S19 for the next line n+1. If print data H, L is not found in first and second image buffers 46, 47, the CPU 41 ends the two-color mode printing process. It should be noted that the flow chart shows returning to step S4 from step S20 after completing step S19 when print data remains in the image buffers, but data IV energizing can be applied separately from step S4 to step S6 using energizing timer 57 and data IV energizing is therefore applied in step S19 while steps S20 and S4, S5, S6 are executing.

The process as it applies to line n+1 is described below primarily with reference to the differences from the process applied to line n.

To print line n+1, energizing data for dots m and m+2 is moved from first image buffer 46 to first line buffer 43, and the result of the logical OR operation on the line n+1 data in first and second image buffers 46, 47 is sent to the second line buffer 44 in step S4.

In step S5, data is transferred from the first line buffer 43 to print buffer 52, and the energizing data for dots m to m+3, that is, the print buffer content for the previous printing operation (i.e., the data for line n, strobe signal IV), is moved to the history buffer 53.

The result of the logic operation using history buffer 53 and print buffer 52 (i.e., no printing dots) is then moved to the thermal head shift register 13 in step S6.

Steps S7 and S8 execute and then in step S9 the content of print buffer 52 (apply energizing dots m and m+2) is transferred to the thermal head shift register 13, and energizing determined by print signal I is applied in step S10 although no dots actually print.

From this point on only steps relating to data transfer are described.

In step S12 the content of second line buffer 44 for line n+1 (apply energizing dots m to m+3) is transferred to print buffer 52, and synchronized thereto data from print buffer 52 (apply energizing dots m and m+2) is transferred to history buffer 53 for use as the previously printed data.

In step S14 the result of the logic operation on print buffer 52 and history buffer 53 (apply energizing dots m to m+3) is transferred to the thermal head 10 shift register 13 as print signal III.

In step S16 print signal IV (apply energizing dots m to m+3) is transferred from print buffer 52 to thermal head 10 shift register 13.

When, as with the data for line n+1, the first color is printed and the same dot printed the last time, first stage heat is higher than when nothing printed the previous time by an amount equivalent to strobe signal I based on print signal I, as shown in FIG. 8 or FIG. 9. As a result, strobe signal II is applied after a pause of a predetermined time period equivalent to strobe signal I (FIG. 9(*b*)) to heat to first peak temperature T1 by means of this first stage heat.

If the print data processing unit 40 detects the monochrome mode in step S2, the process branches from step S2 to the routine shown as steps S100 to S110 in FIG. 5.

This case differs from the two-color print mode in that the print data only indicates whether a particular dot is energizing driven or not without discriminating high and low print data levels, and the control process uses only first image buffer 46 and first line buffer 43. Other aspects of the process are the same as in the two-color print mode described above, and further description thereof is omitted below.

In this embodiment of the invention first and second line buffers 43, 44 are reserved in RAM 42 of print data processing unit 40, and the first color print data H and second color print data L are managed in print data processing unit 40 for transfer from the first and second line buffers 43, 44 to the drive control circuit 50. The drive control circuit 50 can therefore be used as a circuit for thermal history control of monochrome printing to maintain constant temperature output from the heating elements of the thermal head 10 with consideration for thermal history, and the heat output necessary to produce the first color and heat output necessary to produce the second color can be separately controlled and produced at the appropriate heating elements of the thermal head 10.

It is therefore possible to provide a control apparatus 30 featuring a simple circuit configuration and applying thermal history control for a thermal head 10 capable of printing two colors.

As described above the present invention actually prints twice to any same dot on the thermal paper by applying a first stage heat level and a second stage heat level to produce sharp, clear print images while the temperature of the heating elements distributes to thermal paper and becomes substantially flat on it.

Furthermore, by setting the first stage heat level higher than the second stage heat level, any same dot on the thermal paper is first printed with a dark color and then reprinted with a lighter color, thereby clearly defining the outside edges of the print image.

The invention also uses the second heat level alone to print a second color. This also simplifies managing the first color print data H and second color print data L from the print data stream, enables using a common buffer to record print data H and print data L, and thus lightens the load on RAM 42 of print data processing unit 40.

Furthermore, the present invention makes it possible to change the settings of strobe signals I and III according to the type of thermal paper because strobe signals II and IV are the required common signals for print data H and strobe signals I and III are selected based on thermal history. Strobe signal IV is similarly the signal required for print data L and strobe signal III is selectable according to the thermal history, making it also possible to change the value of strobe signal III according to the type of thermal paper.

It will also be noted that by inserting a pause of a predetermined time period between strobe signal II and strobe signal III it is not necessary to use strobe signal III due to thermal history when printing print data (FIG. 9(*b*)(*c*)), and strobe signal III can be normally used for print data L (FIG. 9(*a*)).

Benefits of the Invention

As described above, when printing with the color produced by a first heat output level to a same dot on the thermal paper, the present invention separately applies first and second stage to assure the heat output required to produce the color emitted at the first heat level, actually printing the same dot twice. A sharp, clear first color print image can thus be achieved.

Yet further, the temperature of the heating elements distributes to thermal paper and becomes substantially flat on it. A sharp, clear print image can be achieved furthermore.

By thus setting the first stage heat level higher than the second one, a same dot on the thermal paper is first printed using a dark color and is printed a second time using a lighter color, thereby assuring a well-defined print image. It is also possible to rapidly heat the thermal head heating elements when printing to thermal paper using the first heat output level.

When printing with the color produced by a second heat output level, the present invention can thus sufficiently cool the heating elements of the thermal head by energizing only in the second stage and not in the first stage. It is therefore not necessary to consider thermal history.

In the second stage, the heat output is required to produce the color emitted at the second heat level. A sharp, clear second color print image can thus be achieved.

Furthermore, the output temperature of the heating elements of a thermal head can be held constant with consideration for thermal history even when the drive control circuit is a circuit enabling thermal history control for monochrome printing, and the heat output required to produce the first color and the heat output required to produce the second color can be separately controlled and produced in the individual heating elements of the thermal head. It is therefore possible to provide a control apparatus featuring a simple circuit configuration and applying thermal history control for a thermal head capable of printing two colors.

First stage information can therefore be recorded in a first memory area for first color output data, and second stage information can be stored in a second memory area for first and second color output data. Information relating to the heat output required to produce the first color can therefore be applied to the drive control circuit in first and second stages, and information relating to the heat output required to produce the second color can be applied to the drive control circuit as second stage data.

Furthermore, the present invention enables controlling heat output for producing the first color by means of a first stage energizing command and a second stage energizing command, and controlling heat output for producing the second color by means of a second stage energizing command.

Yet further, heat output required to produce the first color can be controlled using the energizing pulse width determined by a plurality of first and second stage energizing commands.

Yet further, the present invention can appropriately change the energizing pulse width of the initial first stage energizing command, and make the pause of the predetermined time period, so that the temperature generated in the first stage and second stage is flat for a particular heating element of the thermal head. A sharp, clear first color print image can thus be achieved.

Further preferably, the present invention can also appropriately change the energizing pulse width set by the initial second stage energizing command so that the temperature generated in the second stage is flat for a particular heating element of the thermal head. A sharp, clear second color print image can thus be achieved.

The present invention can also selectively energize the heating elements of the thermal head in order to achieve the basic heat output level required to produce the first and second colors, and to achieve the heat output required to produce the first and second colors with consideration for thermal history.

This invention also achieves a thermal head printer using a monochrome printing drive circuit applying thermal history control to enable sharp, clear monochrome and two-color printing.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A thermal head control method for controlling different heat output levels by changing the amount of energizing applied to heating elements of a thermal head, comprising the steps of:

(a) energizing the heating elements in a first energizing stage and in a second energizing stage to produce a first color at a first heat output level; and (b) providing a pause of predetermined duration between the first energizing stage and the second energizing stage.

2. A thermal head control method as described in claim 1, wherein:

the pause of predetermined duration is sufficient to permit the second energizing stage to distribute the first heat output level substantially throughout the entire surface of the heating elements.

3. A thermal head control method as described in claim 1, wherein:

the first energizing stage is greater than the second energizing stage.

4. A thermal head control method as described in claim 1, wherein:

the heating elements are energized only in the second energizing stage to produce a second color at a second heat output level.

5. A thermal head control method as described in claim 4, wherein:

the energizing in the second energizing stage is sufficient to produce said second color at a second heat output level.

6. A thermal head control apparatus for controlling heat output from heating elements of the thermal head by changing the amount of energizing applied to each heating element in a thermal head having an array of multiple, independently drivable, heating elements, comprising:

a print data processing unit for processing a print data group that is information relating to the production of color at a specific heating element according to different heat output levels and contains both or either first color data based on a first heat output level and second color data based on a second heat output level lower than the first heat output level, the print data processing unit having:

a first command processing function for converting first color data to a first stage energizing command and a second stage energizing command, a second command processing function for converting second color data to the second stage energizing command, a first memory area for storing the first stage energizing command, and a second memory area for recording the second stage energizing command, and a selector for selectively outputting energizing commands from the first memory area and energizing commands from the second memory area; and a drive control circuit having a first command storage area for storing energizing commands contained in the first memory area or second memory area, and a second command storage area for storing energizing commands contained in the first command storage area, and energizing a specific heating element by means of a energizing command based on a comparison between the first command storage area and second command storage area.

7. A thermal head control apparatus as described in claim 6, wherein the first command processing function of the print data processing unit extracts first color data from the print data group to a first working area and stores it to the first memory area, and the second command processing function extracts second color data from the print data group to a second working area and stores the result of a logic operation on the first working area and second working area to the second memory area.

8. A thermal head control apparatus as described in claim 6, wherein the print data processing unit converts first stage energizing commands and second stage energizing commands to a plurality of energizing commands stored to the memory areas based on print data and the history of energizing the heating elements.

9. A thermal head control apparatus as described in claim 8, wherein the multiple first and second stage energizing commands are energizing pulses, and their energizing pulse width is determined according to the heat output required to produce the first color.

10. A thermal head control apparatus as described in claim 9, wherein the energizing pulse width of the multiple second stage energizing commands is determined according to the heat output required to produce the second color.

11. A thermal head control apparatus as described in claim 9, wherein the initial first stage energizing command is determined based on a relationship between heat output due to multiple second stage energizing commands and the cooling temperature of the thermal head heating element.

12. A thermal head control apparatus as described in claim 9, wherein the initial second stage energizing command is determined based on a relationship between heat output due to multiple first stage energizing commands and the cooling temperature of the thermal head heating element.

13. A thermal head control apparatus as described claim 8, wherein the drive control circuit runs a last first stage energizing command or last second stage energizing command directly from the storing command storage area based on the print data, and runs energizing commands other than the last first stage energizing command or last second stage energizing command based on a NOT-AND operation between a command storage are a stored based on print data and a previous-print-data command storage area.

14. A thermal head control apparatus as described in claim 8, wherein the drive control circuit comprises an energizing output circuit for outputting an N-th strobe signal at a specific timing for an N-th energizing command, where N is a positive integer.

15. A thermal head control apparatus as described in claim 8, wherein the control apparatus uses the drive control circuit for monochrome printing, and by using only the first stage energizing command prints one line using half the energizing commands used for two-color printing.

* * * * *

UNITED STATES PATENT AND TRADEMARK OFFICE

CERTIFICATE OF CORRECTION

PATENT NO. : 6,747,683 B2
DATED : June 8, 2004
INVENTOR(S) : Satoshi Nakajima et al.

It is certified that error appears in the above-identified patent and that said Letters Patent is hereby corrected as shown below:

Column 14,
Line 53, change “are a” to -- area --.

Signed and Sealed this

Fifth Day of October, 2004

JON W. DUDAS
*Director of the United States Patent and Trademark Office*